United States Patent [19]

Auer et al.

[11] 4,105,382

[45] Aug. 8, 1978

[54] APPARATUS FOR THE PRODUCTION OF FINISHED PRESTRESSED CONCRETE MEMBERS

[75] Inventors: Peter Auer, Ottobrunn; Fritz Kluge, München-Grosshadern; Helmut Lieske; Horst Wutzler, both of Munich, all Germany

[73] Assignee: Dyckerhoff & Widmann Aktiengesellschaft, Munich, Fed. Rep. of Germany

[21] Appl. No.: 780,021

[22] Filed: Mar. 22, 1977

[30] Foreign Application Priority Data

Apr. 1, 1976 [DE] Fed. Rep. of Germany ..... 2614036

[51] Int. Cl.[2] ..... B28B 3/04

[52] U.S. Cl. ..... 425/88; 425/111; 425/125; 425/347; 425/420; 425/421; 425/454

[58] Field of Search ..... 425/88, 111, 258, 420, 425/421, 432, 454, 125, 347; 249/86

[56] References Cited

U.S. PATENT DOCUMENTS

| | | | |
|---|---|---|---|
| 3,732,052 | 5/1973 | Gunia | 425/88 |
| 3,756,762 | 9/1973 | Maugweiler | 425/421 |
| 3,897,186 | 7/1975 | Farfor | 425/258 |
| 3,998,573 | 12/1976 | Gilbert et al. | 425/420 |
| 4,028,036 | 6/1977 | Farfor | 425/385 |

*Primary Examiner*—Francis S. Husar
*Assistant Examiner*—John McQuade
*Attorney, Agent, or Firm*—Toren, McGeady and Stanger

[57] ABSTRACT

An apparatus for continuously producing finished prestressed concrete wires along a prestressing bed with a plurality of prestressing members which extend along the prestressing bed and which are arranged to pass through the concrete members when formed. The apparatus includes a scaffold which spans the prestressing bed in a gantry-like fashion and is supported for movement in a direction parallel to the bed. The scaffold extends over at least two adjacent stations along the prestressing bed for producing the finished prestressed concrete members. A number of vertically movable lower form members are carried on the scaffold for movement to a lowered position on the prestressing bed for receiving fresh concrete to form the concrete members. After the concrete members are formed and bonded the lower form member may be raised away from the finished concrete member. Upper form members corresponding in number to the lower form members are also carried on the scaffold for vertical movement into and out of the concrete member forming position. The upper form members are also horizontally movable longitudinally along the scaffold.

16 Claims, 10 Drawing Figures

15
8
6c
24
9
25
20
3
23
2
7
6a
44
14
13
5
21
10
22
12
11
43
16

APPARATUS FOR THE PRODUCTION OF FINISHED PRESTRESSED CONCRETE MEMBERS

BACKGROUND OF THE INVENTION

The invention relates generally to an apparatus for the production of precast concrete units from prestressed concrete with immediate bonding, and, more particularly, to the production of prestressed concrete beams formed in a continuous manner on a prestressing bed along which extend a plurality of prestressing members or tendons which are tensionable against fixed abutments.

In the prior known technique for producing prestressed concrete ties along a prestressing bed a large number of ties are formed along the entire length of the bed in a plurality of side-by-side rows. This prior technique requires the use of as many concrete forms as there are ties being produced. Typically, the ties are produced in an inverted working position, in which each concrete form shapes the top surface and a rail support arranged on the surface of each of the ties. Fastening elements for the rails are secured in the concrete forms and then concrete is poured into the forms and compressed. When the concrete has set sufficiently, the fastening means for the rail fastening elements are detached from the concrete forms and the fastening elements are removed. After the concrete has completely set, the tendons are detached from the anchoring means of the prestressing bed so that the tension is transmitted to the ties. Subsequently, the tendons between the individual ties are separated, the ties turned over into a working position and the projecting ends of the tendons are then removed.

This previously known method of producing concrete ties requires a great number of concrete forms, since the concrete must harden within the forms. Because the forms are open at the top and the concrete is compressed only as a result of vibrating the forms, the previous technique is not capable of sufficient compression of the concrete which would permit rapid stripping of the forms. Since only rapid stripping of the forms would allow them to be reused, the previously known technique has the disadvantage that a great number of forms are required and cannot be reused.

Accordingly an object of the present invention is to provide an apparatus which permits rapid stripping of freshly poured ties on a prestressing bed during the production of finished members, particularly prestressed concrete ties, so that the number of forms required can be kept at a minimum.

It is another object of the present invention to provide an apparatus capable of the mechanized production of prestressed concrete ties which has superior qualtiy characteristics.

Other objects, features and advantages of the present invention will become more apparent from the description of the invention in connection with the accompanying drawings, to be described more fully hereinafter.

SUMMARY OF THE INVENTION

The present invention accomplishes the foregoing objects by providing an apparatus for continuously producing prestressed concrete members along a prestressing bed which comprises a gantry-like scaffold spanning the bed and supported for movement in a direction parallel to the bed. The scaffold longitudinally extends over at least two adjacent production stations along the prestressing bed for producing the finished prestressed concrete members in their proper working position. The scaffold is provided with a plurality of lower form members corresponding to the number of rows of finished concrete members to be produced. The lower form members are mounted for vertical movement between a position for receiving the concrete and forming the members and a position removed from the forming position. The scaffold carries upper form members corresponding to each of the lower form members which are also mounted for vertical movement and can be moved in a horizontal direction longitudinally along the scaffold.

As a result of the present invention, only a very small number of concrete forms are required for producing the prestressed concrete ties along the prestressing bed. The present invention only requires the number of forms which correspond to the number of concrete ties produced at each production station.

The present invention also provides that the concrete members are intensively compressed by applying a load supported above the upper form members. Therefore, the concrete ties or finished members can be formed in their proper working position so that, immediately after the compression of the concrete, the concrete forms can be lifted away from the finished member and reused for the formation of a new concrete member. Because of the intensive compression afforded by the present invention, it is also possible to use a relatively stiff concrete mix in its fresh state having a low water-cement factor and a relatively low content and still obtain a very high quality concrete member.

Because only a small number of concrete forms are required by the present invention, it is relatively easy to exchange these forms for other concrete forms having different finished shapes so that different type concrete members can easily be formed using the present invention. This is of particular advantage when producing prestressed concrete ties since different types of ties can be rapidly formed at relatively reasonable costs. The present invention provides a further advantage in that, at the time when the prestressing force is being transmitted from the tension members to the finished concrete members, the finished concrete members are completely free of the forms. As a result, the finished concrete members will not seize in the forms, which is likely to happen when presetressing forces are transmitted to the finished concrete members while they are still within the forms.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

The invention will now be described more fully hereinafter in connection with the following drawings in which.

DESCRIPTION OF THE INVENTION

Figure 1:
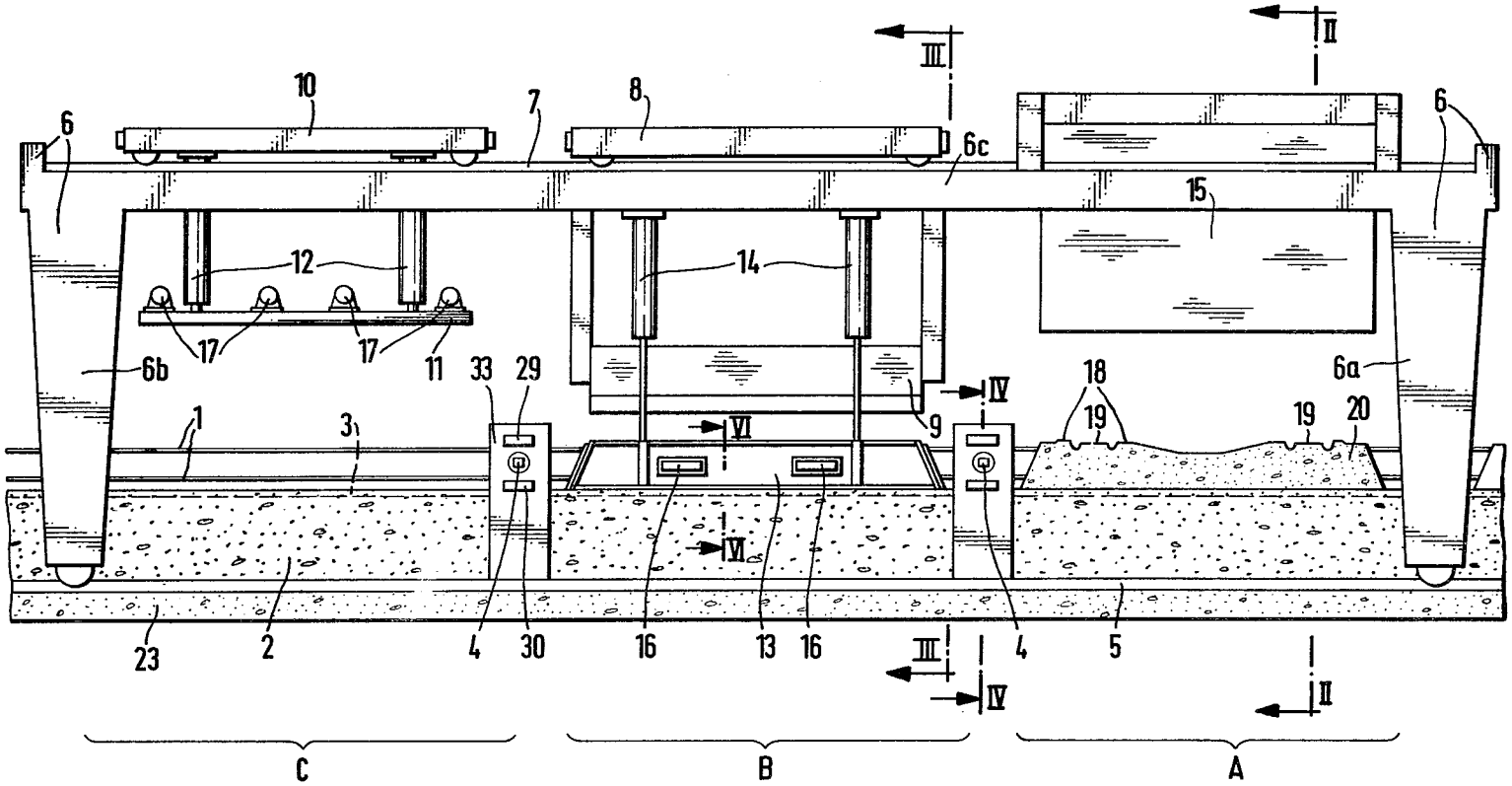
FIG. 1 is a side elevational view of the apparatus in accordance with the present invention.

Referring now in greater detail to the accompanying drawings, FIG. 1 shows the apparatus of the present invention for the production of prestressed concrete ties along a prestressing bed.

The prestressing bed 2 consists of an extended continuous concrete foundation. Prestressing wires 1 are stressed against or between fixed abutments (not shown) located at the ends of the bed 2 and are arranged above the bed. A vibration damping coating 3 is applied on top of the prestressing bed.

Individual production stations at which at least one and possibly several ties can be produced in side-by-side relation are provided along the prestressing bed. FIG. 1 shows three such production stations indicated as A, B and C. Two individual prestressed concrete ties in side-by-side relation can be produced at each of the stations A, B and C. Vibration dampers 4 acting on the prestressing wires, which will be described more fully hereinafter, are arranged between each of the production stations.

Separate foundations 23 are laid on each side of the bed 2 and each of the separate foundations 23 supports a rail 5 on which a scaffold 6 is movably supported. The foundations 23 are separated from the bed 2 in order to prevent the transmission of any vibrations from the scaffold to the bed. The scaffold includes two portal frames 6*a* and 6*b*, which are joined by lateral longitudinal beams 6*c* at their upper ends. Rails 7 are arranged on the longitudinal beams 6*c*. A truck 8 carrying concrete weighing containers 9 joined together by cross beams 44 is arranged for horizontal movement along the rails 7. A truck 10 carrying upper form members 11 secured thereto is also arranged for movement along the rails 7. The upper form members 11 are arranged for vertical movement by means of hydraulic cylinders 12. Vibrators 17 are secured to the outside of the upper form members 11.

A pair of lower form members 13 joined together by cross beams 43 are carried on scaffold 6 and are also arranged for vertical movement by hydraulic cylinders 14. Upon actuation of the hydraulic cylinders 14 the lower forms 13 are lowered onto the prestressing bed 2 into a forming position for receiving concrete and can then be lifted from the bed for removal from the completed concrete member. Vibrators 16 are arranged on the outside of the lower form members 14 for compressing the concrete when in the forms. Finally, a storage tank 15 for fresh concrete is provided at one end of the scaffold 6.

The sequence of operations in producing the prestressed concrete ties using the apparatus according to the present invention will now be described.

Figures 2, 3A, 3B, 3C:
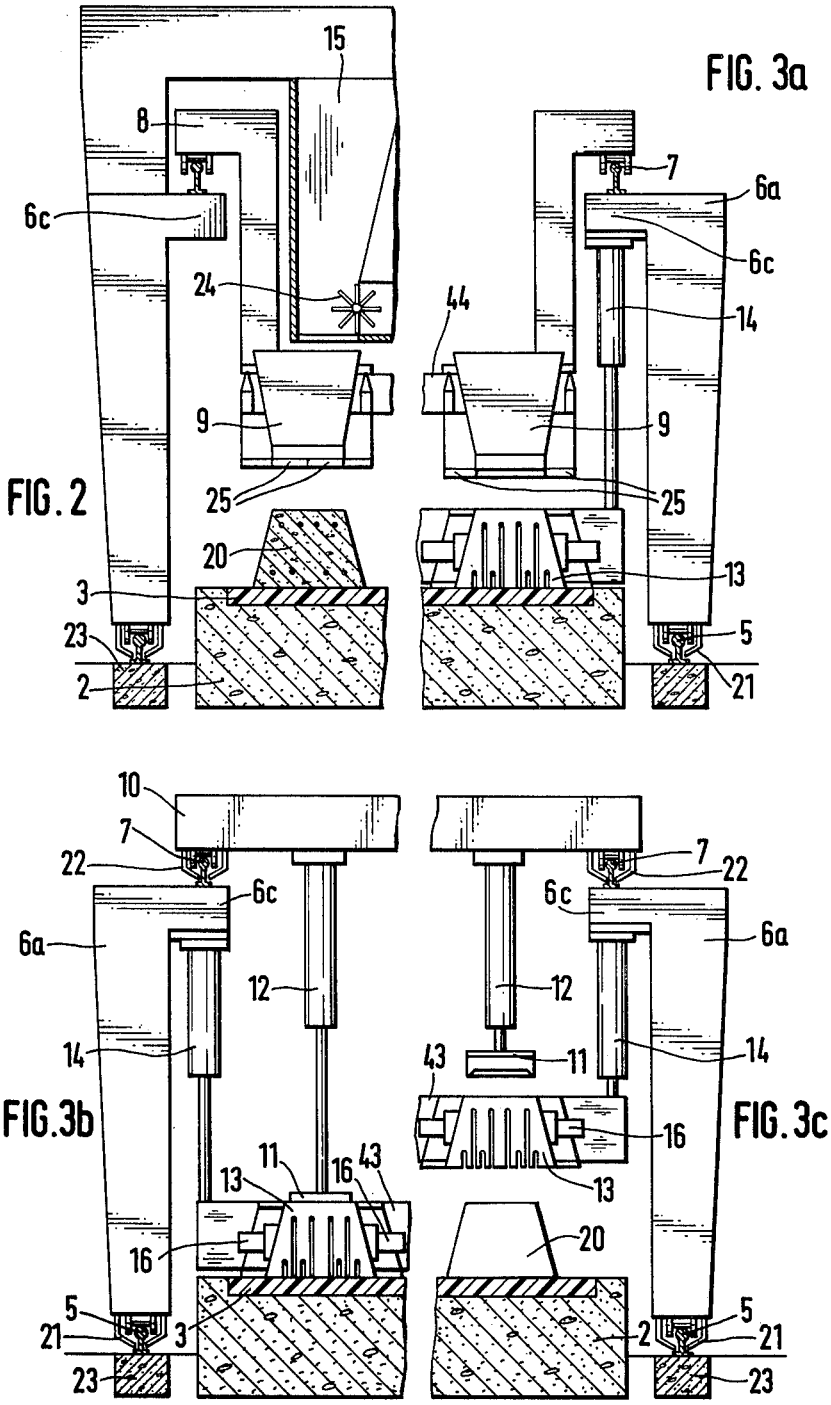
FIG. 2 is a sectional view taken along lines II—II in FIG. 1 showing the stage of production during which weighing containers are being filled.
FIGS. 3*a*, 3*b* and 3*c* are sectional views taken along lines III—III of FIG. 1 showing three different stages in the production of the prestressed concrete members.

Scaffold 6 is first moved along the rails 6 with the lower form members 13 in a raised position as a result of operation of the hydraulic cylinders 14, until the lower form members are positioned above the production station B. At this point the scaffold 6 is locked in position on rails 5 by means of rail clamps 21 to prevent any further movement during the forming operation. The lower form members are then lowered by means of the hydraulic cylinder 14 over the stretched prestressing wires 1 onto the vibration damping coating 3. This position is shown in FIG. 3*a*.

The concrete weighing containers 9 suspended from truck 8 are initially positioned under the storage tank with the bottom closure 25 of the weighing containers 9 in the closed position. The containers 9 are filled with concrete from the storage tank 15 by means of a feeding device 24, which can be seen by removing the front wall of the storage tank 15. After an appropriate amount of concrete has been weighed, the weighing containers 9 are moved over the lower form members 13 and emptied by opening the bottom closure 25 (see FIG. 3*a*). The use of the weighing containers 9 permits uniform filling of the lower form parts 13 thus greatly facilitating the manufacturing operation for producing the ties. Simultaneously with emptying the concrete from the weighing containers 9 into the lower form 13, the vibrators 16 on the outside of the lower forms 13 will begin vibrating for precompression of the fresh concrete being poured into the form. Truck 8 carrying the weighing containers 9 will then move back under the storage tank 15 where the weighing containers may once again be filled with fresh concrete.

While the fresh concrete is being compressed in the lower form members 13 by means of the vibration of vibrators 16, and after the truck has moved the weighing containers away from the station, truck 10 carrying the upper form members 11 will move into a position over the lower form members 13 and be locked on rails 7 by rail clamps 22. The upper form members 11 will then be lowered by means of hydraulic cylinders 12 and be pressed onto the precompressed concrete in the lower form members 13 such as shown in FIG. 3*b*.

Outside vibrators 17 secured to the upper form member 11 will now be placed in operation so that both vibrators 16 and vibrators 17 will be in operation for compressing the concrete within the form. As a result of upper form member 11 pressing upon the concrete within the form, the tie member cover surface 18 will be formed with tie rail supports 19 arranged thereon as will be seen from the stripped tie 20 (i.e. a finished tie after the form has been removed) which is positioned at the production station A. Rail fastening parts (as can be seen more readily in FIGS. 7 and 8) to be attached to the tie, which are secured on the upper form member 11, are forced into the tie during the compressing operation.

The use of the vibration damping coating 3 on the prestressing bed, and the use of the vibration dampers 4 which are used to fix the prestressing wires 1 on both sides of the production stations, A, B and C are necessary in order to protect freshly stripped tie members 20 at the production station A against any vibrations during the production of tie members at adjacent production stations. Such vibrations could be harmful and lead to damage of the completed stripped tie.

After the concrete within the forms has been compressed to a desired degree, the outside vibrators 16 and 17 are shut off, the fastening means for the rail fastening parts on the upper form member 11 are loosened, and the lower form members 13 are slightly lifted from the vibration damping coating 3 until they are free of the lateral and front faces of the completed concrete member. The upper form members 11 are then completely lifted from the freshly poured concrete member and the lower form members 13 are raised into the position shown in FIG. 3*c*. Finally, the upper form members 11 are moved by truck 10 to the next position of scaffold 6 (toward the left in FIG. 1). After the lower form members 13 have been completely lifted away from the freshly poured concrete tie members, the scaffold 6 can be moved to the next production station C where the same operation again takes place.

Figure 4:
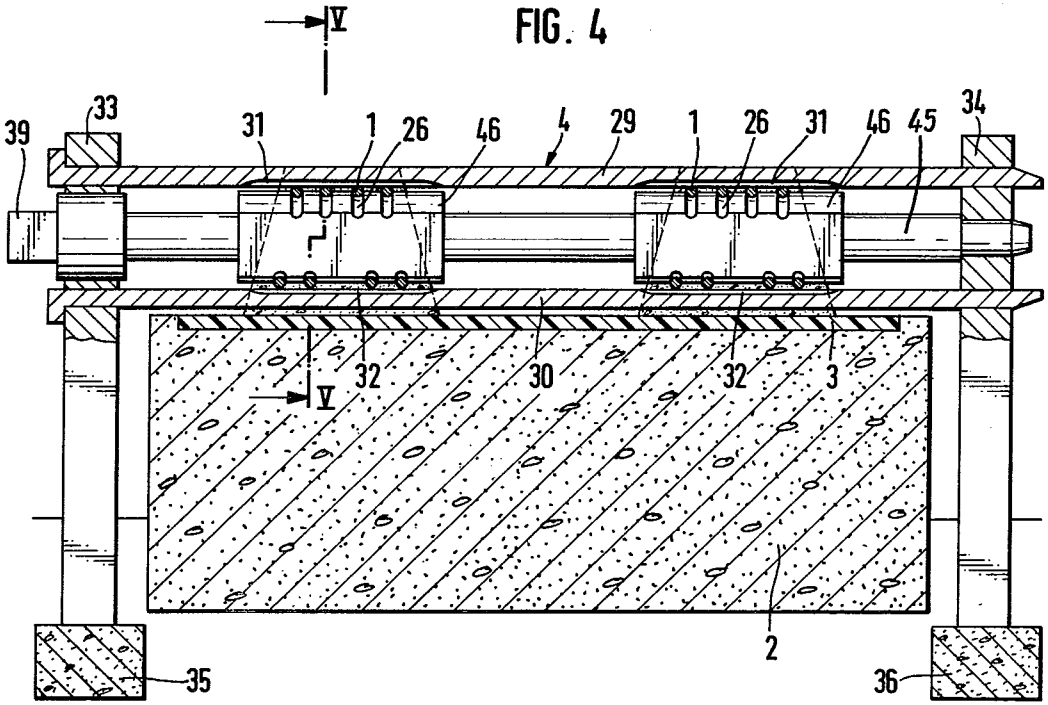
FIG. 4 is a sectional view taken along lines IV—IV of FIG. 1 showing a device for fixing the tension members or tendons.
Figure 5:
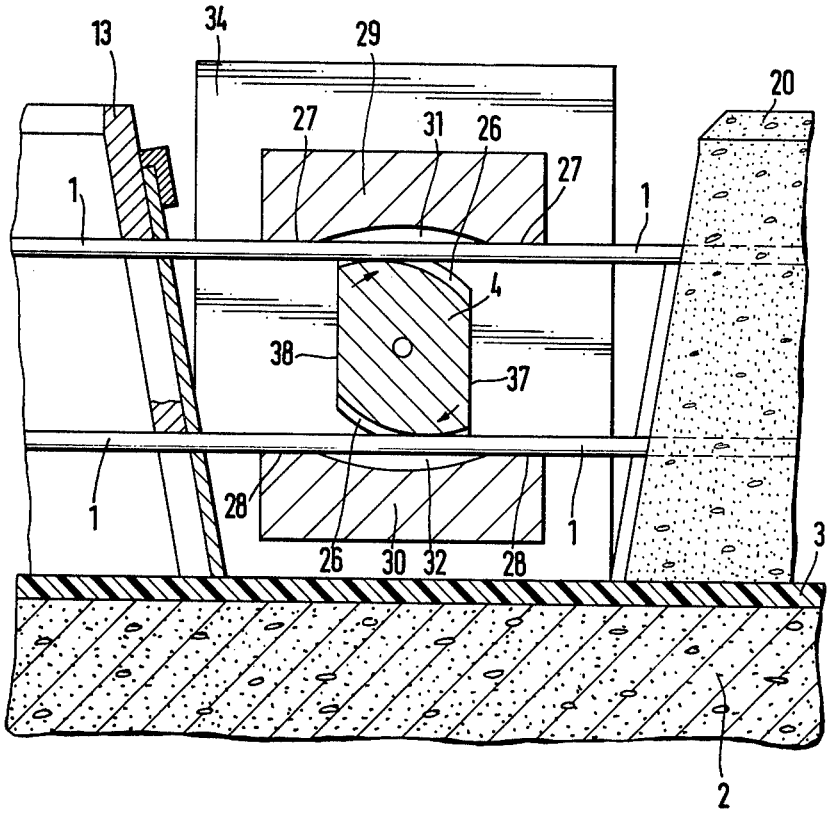
FIG. 5 is a sectional view taken along lines V—V of FIG. 4.

Referring now to FIGS. 4 and 5 which are sectional views taken along lines IV–IV and V—V of FIGS. 1 and 4 respectively the details of the vibration damper 4 for damping the vibrations in prestressing wires 1 is illustrated. A shaft 45 is mounted between two bearing frames 33 and 34 and carries two eccentrics 46 each of which has grooves 26 on a curved outer surface. The grooves on the surfaces of the eccentrics 46 correspond to the cross section of the prestressing wires 1. When shaft 45 is rotated in a clockwise direction (as viewed in FIG. 5) the tension wires 1 are pressed against contact surfaces 27 and 28 on the arm brackets 29 and 30 and into recesses 31 and 32 on the arm brackets. Arm brackets 29 and 30 and bearing frame 33 and 34 are supported on vibration insulated foundations 35 and 36 so that as a result of the wires 1 being engaged by the eccentrics 46, the vibration imparted to the wires as a result of vibrating the lower form member 13 (on the left side of FIG. 5) is not transmitted over the contact surfaces 27 and 28 of arm brackets 29 and 30 to the freshly poured stripped tie 20 (on the right side of FIG. 5). In this manner, the stripped tie 20 is protected against the undesirable vibrations emanating from the vibration of lower form member 13 through the prestressing wires 1.

When assembling and installing vibration damper 4, arm brackets 29 and 30 are first inserted through the bearing frame 33 until they properly seat in the bearing frame 34. The shaft 45 is then extended through the bearing frame 33 with the faces 37 and 38 of eccentrics 46 extending parallel to the axes of the tension wires 1 until they engage and bear on the bearing frame 34. Shaft 45 can then be rotated in a clockwise direction (as viewed in FIG. 5) until the tension wires 1 are tensioned by the grooves 26 against the contact surfaces 27 and 28. Disassembly of the vibration damper 4 is carried out in the exact reverse order.

Because air rises during the compression of the concrete within the form, and must be allowed to escape during the attachment of the upper form member 11, the underside of the upper form member 11 forming the cover surface 18 of the tie and forming the rail support arrangement 19 must be designed in a manner to avoid a highly porous and thus unusable surface on the one hand and a closed concrete surface on the other hand so that air or vacuum chambers must be provided to permit the air to escape.

Figure 6:
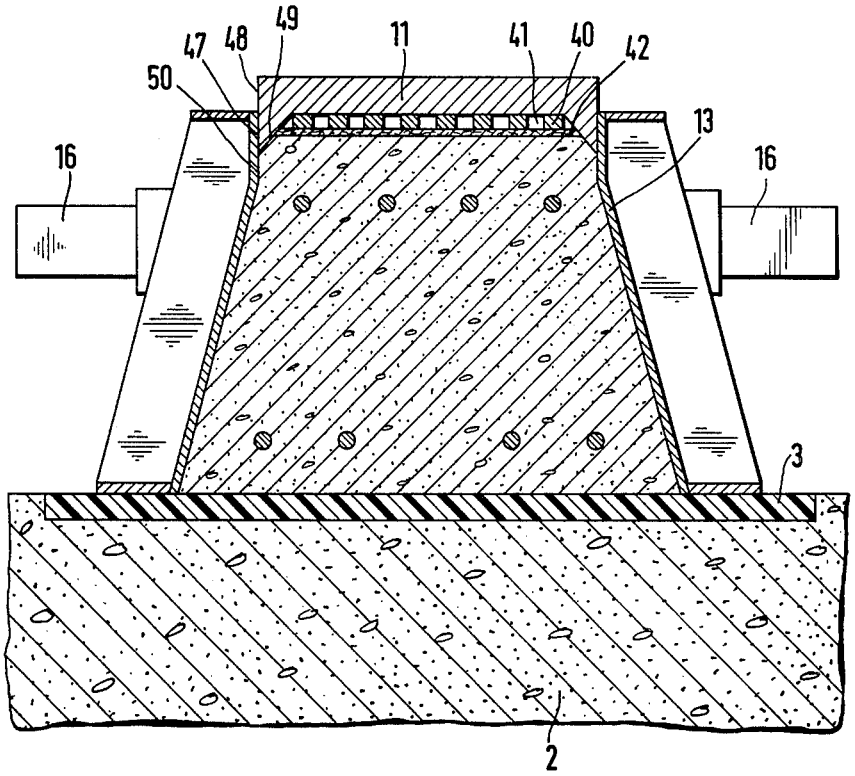
FIG. 6 is a cross sectional view taken along lines VI—VI of FIG. 1 showing a form which has been filled.

This can be accomplished by providing a mesh fabric 40 of wire or plastic as shown in FIG. 6. The mesh fabric 40 may be provided with cavities 41 which bear on a finely-meshed, cloth-type, air-permeable fabric 42 which prevents cement from penetrating into the cavities 41. The cavities 41 can be connected to a vacuum pump. Vertical faces 47 on the upper longitudinal edges of the lower form member 13 are arranged to guide vertical faces 48 on the upper form member 11 which carries an inwardly facing bevel 49 on an edge reinforcement, as will be appreciated from FIG. 6. Because of the amount of concrete which is poured into the lower form member 13 and thereafter compressed, fluctuations in the total height of the tie within the framework of admissible tolerances can occur. Accordingly, the mating vertical surfaces 47 and 48 of the lower and upper form members 13 and 11, respectively, form a vertical surface 50 of the tie member which may be variable in height so as to provide an exact transition between the lateral surfaces of the tie member and the cover surface 18 thereof.

Figure 7:
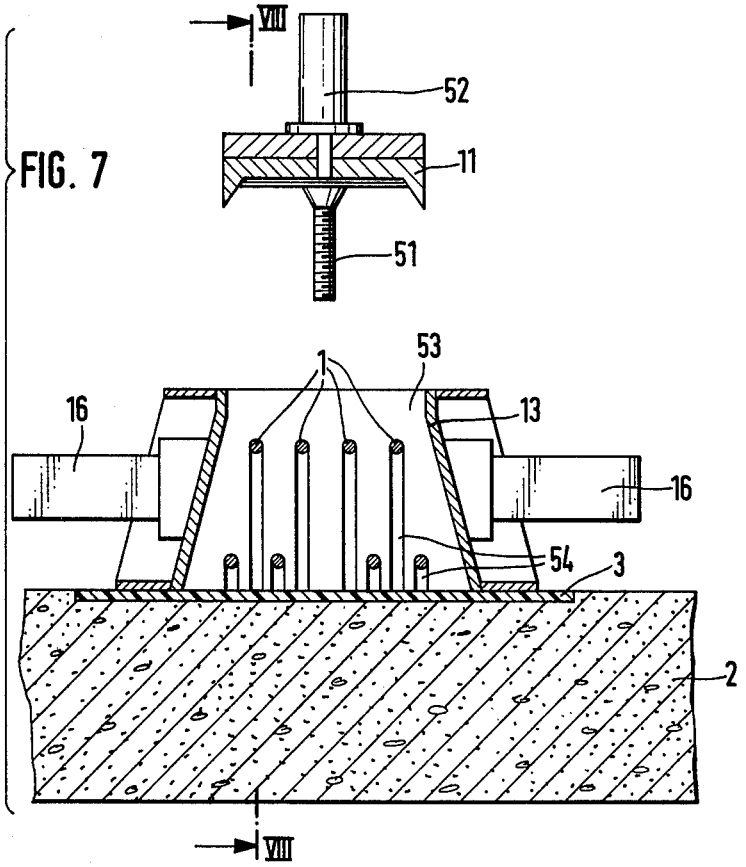
FIG. 7 is a sectional view taken through an empty concrete form.

The upper form member 11, is shown in cross section in FIG. 7 as having a rail fastening part secured thereon to be secured into the tie. The rail fastening part may be a corrugated plastic dowel 51 for receiving a tie screw with which elastic and track forming rail fastening means can be secured on the prestressed concrete tie. FIG. 7 further illustrates the fastening means 52 for the corrugated plastic dowel 51 on the upper form member 11 and also shows the bottom form member 13 resting on the vibration damping coating 3 of the tension bed 2. End faces 53 of the lower form member 13 are provided with slots 54 through which the prestressing wires pass while the lower form member 13 is being lowered into position for receiving the concrete to form the tie member.

Figure 8:
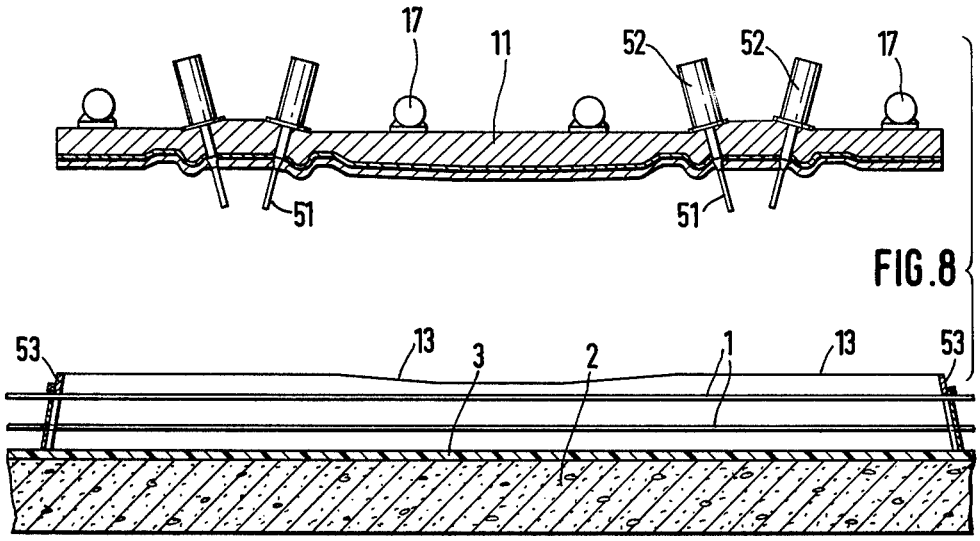
FIG. 8 is a longitudinal sectional view taken through an empty concrete form along lines VIII—VIII in FIG. 7.

FIG. 8, which is a cross sectional view taken along lines VIII—VIII of FIG. 7, shows the upper form member 11 having a profile designed to form the cover surface 18 of the finished tie member. The outline for the rail supports can also be seen from the profile shown in FIG. 8. The manner in which the fastening parts 51 are to be extended into and secured to the concrete tie member is also illustrated. FIG. 8 also illustrates the position of vibrators 17 secured to the upper form member 11, the fastening means 52 for the rail fastening parts 51 and the bottom form part 13 positioned on the vibration damping coating 3 of the prestressing bed.

While the invention has been described and illustrated with respect to certain embodiments which produce satisfactory results it will be appreciated by those skilled in the art, after understanding the purposes of the invention that various additional changes and modifications may be made without departing from the spirit and scope of the invention and it is therefore intended in the appended claims to cover all such changes and modifications.

What is claimed is:

1. An apparatus for producing finished prestressed concrete member comprising a prestressing bed on which said concrete members are produced having prestressing wires tensioned against fixed abutment members passing therethrough, a scaffold spanning said prestressing bed in gantry-like fashion, said scaffold being supported for movement in a direction parallel to said prestressing bed, said scaffold longitudinally extending over at least two adjacent stations along said prestressing bed for producing said finished prestressed concrete members, a lower form member for each concrete member to be formed at each of said stations are mounted on said scaffold for vertical movement between a position for receiving concrete to form said concrete members and a position removed from said forming position, and an upper form member for each of said lower form members, each of said upper form members mounted on said scaffold for vertical movement into and out of cooperative engagement with its respective lower form member when in the forming position, said upper form members also being mounted for horizontal movement longitudinally along said scaffold.

2. The apparatus according to claim 1 further comprising foundations extending along and separated from opposite sides of said prestressing bed, a rail carried on each of said foundations, and means mounted on said rails supporting said scaffold movably along said rails.

3. The apparatus according to claim 1 wherein each of the lower form members associated with a production station along said prestressing bed are joined together by a cross beam, and hydraulic cylinders connected with said cross beams and said scaffold for mounting said lower form members for vertical movement on said scaffold.

4. The apparatus according to claim 1 further comprising longitudinally extending rails carried on said scaffold, a truck mounted for movement on said rails, and hydraulic cylinders mounted on said truck for supporting therefrom said upper form members for vertical movement.

5. The apparatus according to claim 1 wherein said scaffold extends over at least three adjacent production stations along said prestressing bed for simultaneously forming a plurality of concrete members, and further comprising means for feeding fresh concrete to said lower form members for forming said concrete members, said feeding means including at least one weighing container mounted for longitudinal horizontal movement on said scaffold.

6. The apparatus according to claim 5 wherein a weighing container is provided for each of said lower form members at each of said production stations.

7. The apparatus according to claim 6 wherein adjacent weighing containers are connected by a cross beam, and further comprising a truck mounted for longitudinal movement along said scaffold on rails extending therealong, said weighing containers being suspended from said truck.

8. The apparatus according to claim 5, further comprising a storage tank carrying a supply of fresh concrete mounted on said scaffold, said weighing container arranged for movement underneath said storage tank for receiving fresh concrete therefrom.

9. The apparatus according to claim 1 further comprising a vibration damping coating carried on said prestressing bed.

10. The apparatus according to claim 1 further comprising means positioned between said production stations for fixing said prestressing wires against the transmission of vibrations from one production station to the next.

11. The apparatus according to claim 10 wherein said prestressing wires are arranged in two superposed planes, and wherein said means for fixing said prestressing wires against transmission of vibrations comprises a pair of bearing frames supported on opposite sides of said prestressing bed on foundations separated from said prestressing bed, upper and lower arm brackets mounted between said bearing frames and extending across said prestressing bed above and below said prestressing wires, respectively, and means supported between said bearing frames for pressing said prestressing wires against said arm brackets for locking said prestressing wires thereagainst.

12. The apparatus according to claim 11 wherein said arm brackets are formed as beams having flat rectangular cross sections, each of said beams being provided with a recess on a side thereof facing said prestressing wires and extending in the longitudinal direction of said beam, said means for pressing said wires against said arm brackets comprises a shaft mounted between said bearing frames, and eccentric members mounted on said shaft for engaging said wires when said eccentric members are rotated.

13. The apparatus according to claim 12 wherein each of said eccentric members has a substantially parallelogram shaped cross section, two opposite sides thereof being curved and provided with grooves for receiving said prestressing wires.

14. The apparatus according to claim 1 further comprising a vertical face longitudinally extending along an upper edge of each of said lower form members, and a corresponding vertical face of said upper form members, said vertical face of said lower form members arranged for guiding and mating with said corresponding vertical face of said upper form members when said upper form members are moved into cooperative engagement with said lower form members.

15. The apparatus according to claim 14 wherein each of said upper form members has an inwardly directed edge reinforcement forming bevel surfaces extending inwardly of said upper form members.

16. The apparatus according to claim 14 further comprising a mesh layer positioned on the inside of said upper form members, said mesh layer forming cavities, and an air permeable layer carried on said mesh layer for preventing cement from entering said cavities and permitting air passage therethrough.

* * * * *